United States Patent [19]

Bemiss

[11] 4,300,891

[45] Nov. 17, 1981

[54] APPARATUS FOR DECURLING A CONTINUOUS WEB

[76] Inventor: Robert P. Bemiss, #5 Drayton Rd., Hillsborough, Calif. 94010

[21] Appl. No.: 134,685

[22] Filed: Mar. 27, 1980

[51] Int. Cl.[3] ..... D21F 7/00

[52] U.S. Cl. ..... 493/8; 162/271; 493/461

[58] Field of Search ..... 493/459, 461, 460, 24, 493/8; 162/271, 270; 101/420, 422, 232; 226/197, 199

[56] References Cited

U.S. PATENT DOCUMENTS

| | | | |
|---|---|---|---|
| 905,465 | 12/1908 | Scherf | 162/271 |
| 2,339,070 | 1/1944 | Hayes | 493/461 |
| 2,531,619 | 11/1950 | Gonia | 493/461 X |
| 3,498,878 | 3/1970 | Obenshain | 162/271 |
| 3,661,703 | 5/1972 | Shelor | 162/271 |
| 3,799,038 | 3/1974 | Bossons et al. | 493/461 X |
| 3,971,696 | 7/1976 | Manfredi | 493/461 X |
| 4,106,166 | 8/1978 | Henning | 162/271 X |

*Primary Examiner*—James F. Coan
*Attorney, Agent, or Firm*—Gerald L. Moore

[57] ABSTRACT

A method and apparatus for decurling a web of material such as paper wherein the web is caused to pass over elongated members positioned in the plane of the web and at an acute angle to the direction of advancement to bend the web both lengthwise and crosswise simultaneously.

11 Claims, 3 Drawing Figures

APPARATUS FOR DECURLING A CONTINUOUS WEB

BACKGROUND OF THE INVENTION

This invention relates to decurlers suitable for taking the curl out of sheet material in web or roll form such as paper and paperboard. Curl in paper results in the tendency of the sheet material to curve or warp due to stresses or other factors within the material. For instance roll curl is caused from the material being wound into rolls for storage and material shipment. This curl runs along the web or grain in the direction known as the machine direction.

Another factor causing curl in sheet material is coating on the flat surface of one side. If the paper is coated on one surface or coated more or differently on one surface than the other in a manner such that moisture penetrates into one surface more easily than the other, there results a curl in the direction crosswise of the web due to the uneven swelling and expansion causing tension in the material as the moisture is absorbed.

Prior decurling apparatus of the general type to which the subject invention pertains are shown in U.S. Pat. Nos. 2,399,070, Sheet Decurling Apparatus, issued on Jan. 11, 1944; 2,531,619, Machine for Decurling Labels, issued on Nov. 26, 1950; 3,661,703, Decurling Apparatus, issued on May 9, 1972 and 3,799,038, Curl Corrector Apparatus for Operating on a Continuous Web, issued Mar. 26, 1974.

Such prior decurling apparatus have been used in an attempt to remove the curl in an advancing web by positioning the members which deflect the web transverse of the direction of travel. Such apparatus has primarily only removed the curl running lengthwise of the web. It is the purpose of the present invention to remove both lengthwise and crosswise curl in an advancing continuous web.

SUMMARY OF THE INVENTION

A method and apparatus for removing curl in a continuously advancing web wherein decurling elongated members which cause a sharp bending of the web are positioned diagonally across and in the same plane as the web, thereby causing bending of the web both longitudinally and transversely to partially sever or fracture the fibers and correct curl therein.

DESCRIPTION OF THE INVENTION

Figure 1:
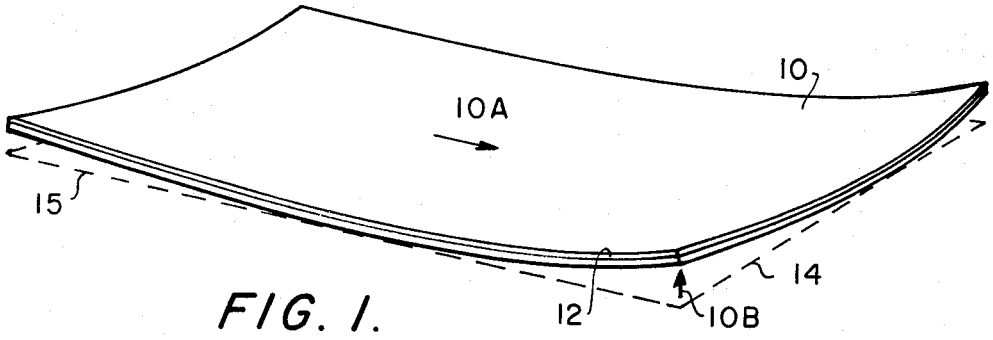
FIG. 1 illustrates a coated paper displaying both coating and roll curl.

In FIG. 1 is shown part of a typical sheet of paperboard such as that used to make liquid or food containers. The machine direction or the direction the web is moved as it is unrolled is indicated by the arrow 11. This paperboard sheet is usually in wide widths and is shown with a coating 12 on the top side thereof, which coating normally is made by the depositing of such materials as polyethylene or the like on the surface of the paperboard. Such coatings make the paperboard waterproof or moistureproof for holding fluids or gravies and the like.

As shown by the dotted outlines 14 and 15 indicating the normal planar configuration of the sheet, the paperboard has warped or curled due to various influences. The curl in the direction of the arrow 10A away from the dotted line 15 is referred to as roll curl, meaning that the primary influence causing the warp is the fact that the paperboard has been stored in a roll and upon being unrolled will retain some of the curvature of the roll. This curl is in the machine or web direction extending lengthwise of the sheet and runs in the same direction as the grain of the paperboard.

Curl away from the dotted line 14 in the direction of the arrow 10B is referred to as a coating curl and is in a cross grain direction. This curl is primarily due to the presence of the coating 12 on the paperboard which prevents the absorption of moisture from the air into that surface of the sheet material. At the same time moisture can be absorbed by the other flat surface of the sheet material causing a swelling and expansion of the fibres. Since this expansion takes place primarily on or near one surface of the paperboard, the warping occurs making the surface which is coated assume a slight concave formation. Other instances of coatings causing curl exist where different coatings are used on opposite sides of the paper, or where some coatings actually contract and cause tension forces in the paperboard.

Of course in the subsequent use of such paperboard, especially in the feeding, cutting and forming of containers, it is beneficial if not absolutely necessary that the sheet material be planar and consistent in structure. Past attempts at correcting curl in paperboard material have generally resulted in the correction of the roll curl only. It is the purpose of the present invention to correct both the roll curl and the coating curl simultaneously such that the sheet material is suitable for making paperboard containers and the like.

Figure 2:
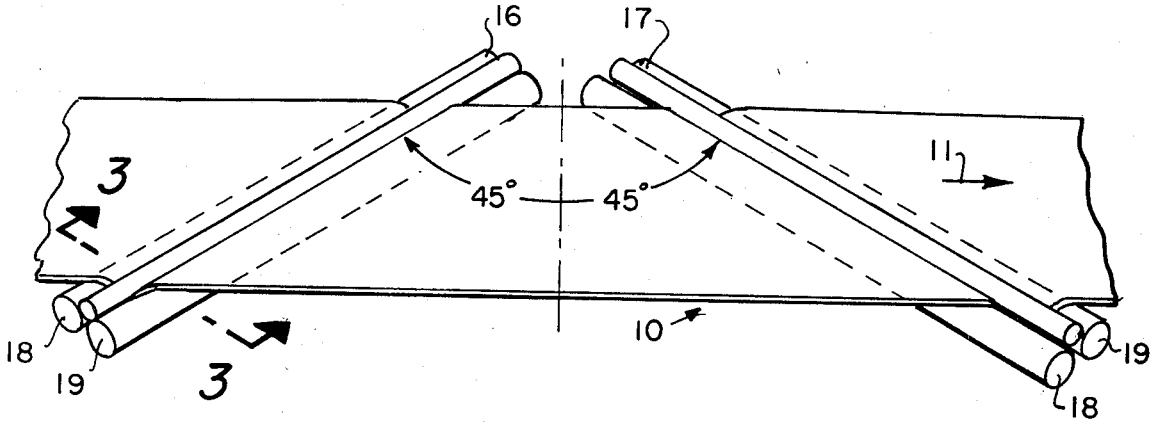
FIG. 2 is a perspective view showing the apparatus of the present invention with the web passing therethrough to remove curl.
Figure 3:
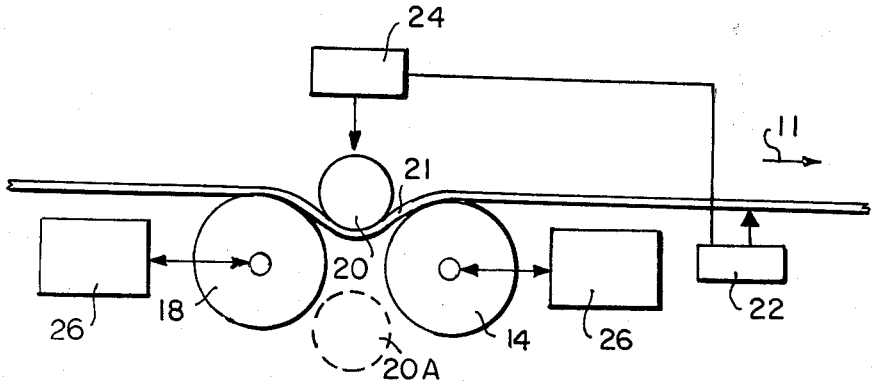
FIG. 3 is a cross-sectional view along the line 3—3 of FIG. 2 with a control in block diagram form for regulating the apparatus.

In accordance with the present invention there is provided a pair of decurling devices 16 and 17 shown in FIG. 2 positioned in the plane of the sheet material 10. In the preferred embodiment these decurling devices are positioned at an angle of approximately 90° relative to each other. Each decurling apparatus comprises a pair of bottom or platen rollers 18 and 19 and a top deflecting roller 20 positioned between and above the bottom rollers. In the preferred embodiment, the platen rollers are approximately 10 inches in diameter and the deflecting roller about 2½ inches in diameter. The rollers are mounted on bearings (not shown) for rotation at the same speed as the sheet material passing thereby and can be power driven or free wheeling. The rollers are positioned as shown in FIG. 3 such that the top roller 20 causes the sheet material in the area 21 to be deflected downward. Such deflection is well-known for decurling of sheet material, however in prior apparatus the decurlers have only been positioned normal to the direction of travel of the web.

By placement of the multiple decurling devices at a right angle relative to each other and at an acute angle relative to the web direction of travel, the deflection of the web occurs on an angle to the web longitudinal axis so as to correct for curling both in the machine direction and in the cross direction. While it is usually preferable that the decurling devices be positioned as shown, i.e. at angles of 45° to the web travel direction, other angular positions of the devices relative to each other and to the web might be found advantageous depending upon the direction and the relative magnitude of the curl and the grain of the sheet material. It also is understood that the decurling devices can be of any type or number causing the deflection of the sheet material for the purpose of correcting the curl therein. For instance, other types of decurling devices are described in the patents mentioned heretofore, some or all of which would be suitable for usage in the subject invention with different types of sheet materials. Additionally non-rotating bars over which the paperboard slides have been found effective in some applications.

As shown in FIG. 3 the decurling apparatus can also include a second deflecting roller 20A for handling sheet material requiring deflection upwards instead of downwards for decurling. The roller 20A can either be an additional roller or in the alternative, can be provided by the shifting of the roller 20 downward between the rollers 18 and 19 after these rollers are moved further apart. Thereafter the sheet material is threaded below the rollers 18 and 19 and above the roller 20A for deflection in the opposite direction.

Also shown in FIG. 3 is a deflection control in schematic form used for the purpose of regulating the tension and deflection of the sheet material. The deflection is measured by the deflection meter 22 which feeds a signal responsive to the curl tension of the web to an actuator 24 for the positioning in the vertical direction of the roller 20. By pushing the roller down further the deflection and tension are both increased, while moving the roller 20 further away from the platen rollers 18 and 19 decreases the tension on the sheet material. Certain materials are more responsive to adjusting the platen rollers 18 and 19 further apart or closer together by energization of the actuator 26. In each instance, however, it is important that the sheet material be deflected both lengthwise and crosswise, preferably simultaneously, to fully correct for curl in the material.

The invention claimed:

1. Apparatus for decurling a continuously advancing web of material having a longitudinal axis extending in the direction of travel, comprising:

first and second decurling apparatus each comprising elongated members spaced in close proximity to each other to bend the web passing therebetween at a sharp angle and impart a decurling effect on the material; and means positioning said first and second decurling apparatus in the plane of the web and at a right angle to each other and at a 45° angle to the longitudinal axis of the web such that each apparatus bends the web both crosswise and lengthwise relative to the longitudinal axis to correct curl therein.

2. Apparatus as defined in claim 1 wherein said decurling apparatus comprises a plurality of parallel-positioned rollers through which the web advances.

3. Apparatus as defined in claim 2 wherein said decurling apparatus comprises first and second rollers positioned on one side of said web and a third roller positioned therebetween and on the other side of said web.

4. Apparatus as defined in claim 3 including means to move said third roller towards and away from said web to regulate the amount said web is bent.

5. Apparatus as defined in claim 4 wherein said means to move said third roller includes continuous means to detect the tension of said web and to regulate the position of said third roller in response to said tension.

6. Apparatus for decurling a continuously advancing web of material having a longitudinal axis extending in the direction of travel, comprising:

a decurling apparatus comprising elongated members positioned in close proximity to each other to bend the web passing therebetween at a sharp angle to impart a decurling effect on the material; and means positioning said decurling apparatus in the plane of said web with the elongated members extending at opposite acute angles to the longitudinal axis of the web thereby to bend the web both crosswise and lengthwise to correct curl therein.

7. Apparatus as defined in claim 6 wherein said decurling apparatus comprises a plurality of parallel-positioned rollers through which the web advances.

8. Apparatus as defined in claim 7 wherein said decurling apparatus comprises first and second rollers positioned on one side of said web and a third roller positioned therebetween and on the other side of said web.

9. Apparatus as defined in claim 8 including means to move said third roller towards and away from said web to regulate the amount said web is bent.

10. Apparatus as defined in claim 9 wherein said means to move said third roller includes means to detect the tension of said web and to regulate the position of said third roller in response to said tension.

11. Apparatus as defined in claim 8 wherein the first and second rollers are adjustable towards and away from each other.

* * * * *